United States Patent [19]

Haddad et al.

[11] Patent Number: 4,999,991

[45] Date of Patent: Mar. 19, 1991

[54] SYNTHESIZED FEEDBACK FOR GAS TURBINE CLEARANCE CONTROL

[75] Inventors: Donald E. Haddad, Amston; Emilio Pereiras, Jr., Shelton, both of Conn.

[73] Assignee: United Technologies Corporation, Hartford, Conn.

[21] Appl. No.: 420,199

[22] Filed: Oct. 12, 1989

[51] Int. Cl.[5] ..... F02C 7/18

[52] U.S. Cl. ..... 60/39.02; 60/39.24; 60/39.75; 415/178

[58] Field of Search ..... 60/39.02, 39.29, 39.75; 415/116, 117, 178

[56] References Cited

U.S. PATENT DOCUMENTS

| | | | |
|---|---|---|---|
| 4,019,320 | 4/1977 | Redinger, Jr. et al. . | |
| 4,069,662 | 1/1978 | Redinger et al. | 60/226.1 |
| 4,242,042 | 12/1980 | Schwarz | 415/116 |
| 4,304,093 | 12/1981 | Schulze | 60/39.75 |
| 4,329,114 | 5/1982 | Johnston et al. . | |
| 4,487,016 | 12/1984 | Schwarz et al. . | |
| 4,849,895 | 7/1989 | Kervistin | 60/39.75 |

*Primary Examiner*—Louis J. Casaregola

*Attorney, Agent, or Firm*—Troxell K. Snyder

[57] ABSTRACT

A method for controlling radial clearance in a gas turbine engine (10) uses a mathematical algorithm to synthesize the current clearance δ, including the transient effects of prior engine operations. The synthesized clearance is compared (202) to a schedule of desired clearance (206) for closing δ a cooling air modulating valve (44) as required to avoid rubbing between the rotating blade tips and surrounding shroud.

1 Claim, 1 Drawing Sheet

SYNTHESIZED FEEDBACK FOR GAS TURBINE CLEARANCE CONTROL

DESCRIPTION

1. Field of the Invention

The present invention relates to a method for controlling the flow of cooling air to the turbine case of a gas turbine engine.

2. Background

The use of a source of relatively cool air impinging upon the external case of the turbine section of a gas turbine engine is known for the purpose of reducing the case temperature and thereby causing a reduction in the radial clearance existing between the tips of the rotating turbine blades and the surrounding annular shroud which is supported by the turbine case. Various methods are also known for modulating the flow of cooling air so as to optimize the clearance and to anticipate transient effects which may result if the engine power level is changed quickly from a steady state value. See, for example, copending, commonly assigned, U.S. Ser. No. 07/372,398, titled Clearance Control Method for Gas Turbine Engine, F. M. Schwarz, et al., which discloses a method for scheduling the flow of cooling air based upon engine power level so as to provide adequate clearance in the event of a step increase in engine power.

As experience has been gained with such systems and methods, it has also been discovered that the transient response of the tip to shroud clearance in a gas turbine engine is additionally a function of the recent history of the operation of the engine. This results from a heat capacity mismatch between the surrounding turbine case and the turbine rotor, wherein the latter is far more massive and, hence have a much greater time constant characterizing the transient response to a change in the temperature of the working fluid passing through the turbine.

In particular, a gas turbine engine experiencing a decrease in engine power level from an operating or cruise power level to a flight idle or other reduced power level, along with a subsequent re-acceleration of the engine to cruise power can experience a thermal mismatch and interference between the rotating blade tips and the surrounding annular shroud. Such interference or contact can result in damage to the shroud and/or blade tips, or premature wearing of the shroud material thereby increasing the radial clearance between the blade tips and shroud for all subsequent operation of the engine. Methods and systems for accurately monitoring the clearance between the blade tips and shroud have proven unreliable and expensive, and may not accurately sense the current transient condition of the components.

What is required is a method for predicting the transient departure of the clearance between the annular shroud and rotating blade tips in a gas turbine engine which does not require additional measuring equipment or information not currently used by gas turbine engine controllers.

SUMMARY OF THE INFORMATION

The present invention provides a method for controlling blade tip to annular shroud clearance in a gas turbine engine wherein a regulated quantity of relatively cool air is blown onto the shroud support case. The method of the present invention, by mathematically estimating the thermal and mechanical transient growth response of the case and blade tips to changes in engine power level and operating condition, provides a synthesized feedback loop to allow the controller to adjust the flow of cooling air to maintain the proper radial clearance between the tips and shroud.

Blade tip to shroud clearance is estimated by calculating the dimensional response of the supporting case and turbine rotor as the result of changes in inlet air pressure and temperature, rotor speed, and engine compressor performance. The estimated differential growth of these components is used by the method according to the present invention to sythesize current clearance, which is compared to a preselected desired clearance. The method then reduces the flow of cooling air during periods of potential blade tip to shroud interference. Reducing case cooling air flow results in an increase in case temperature and diameter, thus increasing the tip to shroud radial clearance.

A simplified algorithm is used for estimating case and rotor dimensional response. The algorithm is responsive to a plurality of engine condition variables, including compressor inlet pressure, compressor outlet temperature, corrected high rotor speed, and corrected low rotor speed.

DETAILED DESCRIPTION

Figure 1:
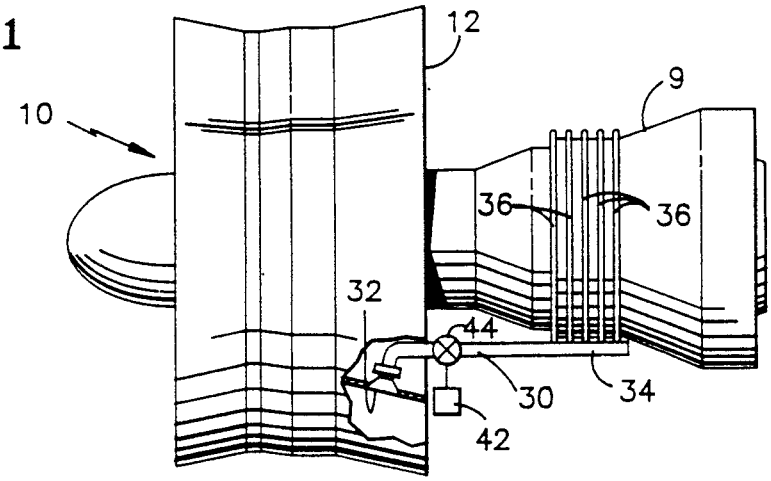
FIG. 1 is a schematic view of a gas turbine engine with a clearance control system for directing a flow of relatively cool air onto the exterior of the turbine case.

FIG. 1 shows a schematic view of a gas turbine engine 10 having a forward fan case 12, and a turbine case 9. Relatively cool air is diverted from the bypass airflow in the fan case 12, entering the turbine case cooling system by means of opening 32 and passing through conduit 30 to header 34. The cool air is discharged against the exterior of the fan case 9 by means of perforated cooling tubes 36 which encircle the turbine case 9. A cooling flow regulating valve 44 is provided for modulating the flow of cooling air in the system, with a controller 42 being used to direct operation of the modulating valve 44. The system as described is well known in the art, as described, for example, in U.S. Pat. No. 4,069,662.

Figure 2:
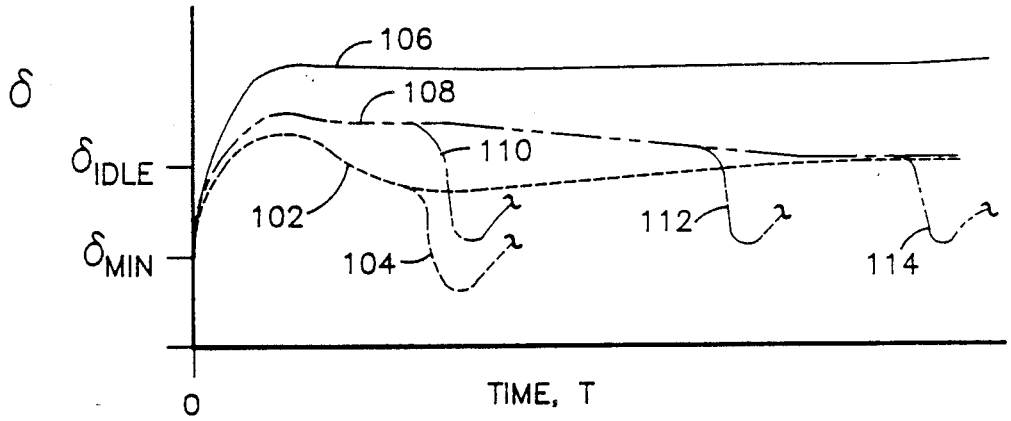
FIG. 2 shows the transient response of the blade tip to shroud clearance in a gas turbine engine experiencing various changes in engine power level.

FIG. 2 shows the transient response of the radial clearance between the rotating blade tips of the turbine rotor (not shown) and the surrounding annular shroud (not shown) which is supported by the surrounding turbine case 9. At $T=0$ in FIG. 2, the gas turbine engine which at $T<0$ has been operating at steady state cruise power level output, experiences a step decrease in power level to flight idle or some other significantly lower power output. The lower broken curved 102 represents the clearance response of the prior art clearance control system using a prior art controller 42 responsive to the current power level of the engine 10. As can be seen from FIG. 2, the clearance $\delta$ increases immediately following $T=0$ as turbine rotor speed drops thus decreasing the centrifugal force on the turbine blades. Clearance is reduced shortly thereafter as the outer case 9 reaches a lower equilibrium temperature as a result of the reduced temperature of the working fluid flowing through the turbine section of the engine, while the rotor and blades, being more massive, are still cooling.

After a sufficient period of time has elapsed, both the turbine rotor and case 9 reach the equilibrium temperature and clearance for idle power level, $\delta_{IDLE}$ but not before the thermal response mismatch has produced a period during which the clearance between the blade tips and shroud is less than the steady state value. Should the engine experience a re-acceleration back to cruise power level within this transient period, clearance will decrease according to broken curve 104 as the turbine rotor speed increases and centrifugal forces on the blades are reimposed before the case 9 has sufficient time to become warmed by the increased temperature working fluid following a step power increase. Thus, curve 104 describes an interference or rubbing condition which can arise in the prior art leading to premature or undesirable damage to the blade tips and shroud in the engine 10.

One solution, described in copending, commonly assigned U.S. patent application titled Method for Protecting Gas Turbine Engine Seals, by Schwarz and Lagueux, filed on even date herewith, is to substantially reduce cooling air flow for a period of time following a step decrease in engine power level, thereby resulting in a uniformly increased clearance as described by solid curve 106. This solution, while effective, produces an excess clearance for at least a short period of time following every decrease in engine power level. The method according to the present invention uses a mathematical model of the transient clearance between the blade tips and shroud to reduce but not eliminate the flow of cooling air to the turbine case 9 following a change in engine power level, directing controller 42 to modulate valve 44 so as to maintain sufficient clearance to avoid interference should the engine be re-accelerated to a higher power level, but maintaining sufficient flow to the cooling tubes 36 so as to eliminate excess clearance.

Curve 108 in FIG. 2 shows the transient clearance response of an engine controlled according to the method of the present invention which produces a transient clearance response curve between the prior art curve 102 wherein the turbine the cooling air is allowed to flow at steady state flow rates, and curve 106 wherein the turbine cooling air is substantially shut off. Re-acceleration transient curves 110, 112 and 114 thus do not result in decrease of the blade tip to shroud clearance below $\delta_{MIN}$, thereby avoiding premature wear and interference between the tips and shroud.

Figure 3:
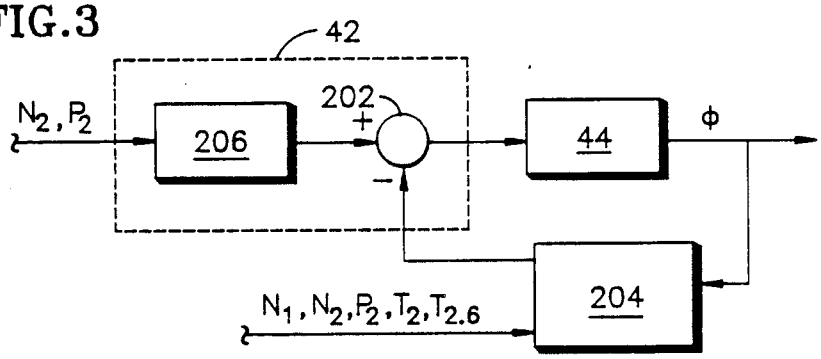
FIG. 3 is a schematic drawing of a control system for executing the method of the present invention.

The method according to the present invention uses a mathematic predictive model for estimating the transient response of the rotor tips and turbine case in order to provide an input parameter to the controller 42 so as to maintain instantaneous radial clearance between the blade tips and shroud has a value which is no less than the required steady state clearance corresponding to the current rotor speed. Thus, as shown in FIG. 3, the controller 42 compares 202 the synthesized instantaneous clearance 204 between the tips and shroud against a schedule of desired clearance 206, the modifies the position $\phi$ of modulating valve 44 to increase the instantaneous clearance.

The algorithm described below is a simplified version of various complex mathematical treatments of the rotor and case for a gas turbine engine.

Thus, the instantaneous clearance $\delta$ between the blade tip and shroud is given by the following equation:

EQUATION 1

$$\delta = G'_{case} - G'_{rotor} - G_w(N_2)$$

wherein $G'_{case}$ = current inner radius of shroud due to thermal effects $G'_{rotor}$ = current outer radius of blade tips due to thermal effect, and $G_w(N_2)$ = current outer radius of blade tips due to centrifugal effect of rotor speed, $N_2$.

The mathematical model according to the present invention next determines the variation of $G'_{case}$ and $G'_{rotor}$ for incremental time steps, using the differential variation to recompute the current radii of the shroud and rotor thereby producing the synthesized clearance used by the controller. Thus,

EQUATION 2

$$\frac{dG'_{case}}{dt} = g_{case}(m)\, h(\phi)[G_{case}(N_2,\phi) - G'_{case}]$$

wherein:

$g_{case}(m)$ = case growth factor as a function of below-defined flow parameter m $h(\phi)$ = heat transfer effectiveness factor as a function of the valve position $\phi$ $G_{case}(N_2,\phi)$ = predicted shroud inner radius at time = $\infty$ for given $N_2$ and $\phi$ $[G_{case}(N_2,\phi) - G'_{case}]$ represents a driving or forcing function which reflects the instantaneous difference between the steady state shroud inner diameter as would result from the current rotor speed and modulating valve setting, and the current shroud inner diameter. This forcing function, modified by the factors $g_{case}(m)$ and $h(\phi)$ are used to determine the incremental change in shroud diameter per unit time. The mathematical method according to the present invention thus continually synthesizes a shroud diameter for use by the control system.

Likewise, the rate of change of the rotor diameter per unit time is calculated by the following equation:

EQUATION 3

$$\frac{dG'_{rotor}}{dt} = g_{rotor}(m)[G_{rotor}(N_2) - G'_{rotor}]$$

wherein:

$g_{rotor}(m)$ = rotor growth factor as a function of below defined flow parameter m $G_{rotor}(N_2)$ = predicted rotor outer radius at time = $\infty$ for a given $N_2$ The rate of change of the rotor outer diameter is thus the rotor growth factor $g_{rotor}(m)$ multiplied by the forcing function $[G_{rotor}(N_2) - G'_{rotor}]$. It should be noted that the steady state values of both the rotor and shroud radii are both primarily functions of the rotor speed $N_2$ which is directly related to engine power. Only the shroud, affected by the flow of cool air as represented by the modulating valve position $\phi$ can be influenced by the controller and engine operator.

The flow parameter m is determined by from the followinq equation:

EQUATION 4

$$m = \frac{W_{2.6}\sqrt{\theta_{2.6}}}{\delta_{2.6}} \frac{P_{2.6}}{P_2} P_2 (T_{2.6})^{-.5}$$

wherein:

$W_{2.6}$=low pressure compressor outlet mass flow $\theta_{2.6}$=low pressure compressor outlet relative temperature, $\delta_{2.6}$=low pressure compressor outlet relative pressure $P_{2.6}$=low pressure compressor outlet absolute pressure $P_2$=low pressure compressor inlet absolute pressure $T_{2.6}$=low pressure compressor outlet total temperature Flow factor m, for a given gas turbine engine can be further simplified as a result of certain known engine performance relations, and calculated with reference to the following tables wherein low rotor speed $N_1$, high rotor speed $N_2$, low pressure compressor inlet pressure $P_2$, and low pressure compressor outlet temperature $T_{2.6}$ and low pressure compressor inlet temperature $T_2$ are known. Thus, for the V2500 gas turbine engine as produced by International Aero Engines, the following relations as set forth in Tables 1-6 hold.

TABLE 1

| $\frac{N_1}{\sqrt{\theta_2}}$ | 1,000 | 2,400 | 3,200 | 4,000 | 4,800 | 5,600 |
|---|---|---|---|---|---|---|
| $\frac{P_{2.6}}{P_2}$ | 1.02 | 1.15 | 1.30 | 1.62 | 2.01 | 2.06 |

TABLE 2

| $\frac{N_2}{\sqrt{\theta_{2.6}}}$ | 8,000 | 10,250 | 12,000 | 13,200 |
|---|---|---|---|---|
| $\frac{W_{2.6}\sqrt{\theta_{2.6}}}{\delta_{2.6}}$ | 19 | 27 | 58 | 84 |

TABLE 3

| $G_{case}(N_2,\phi)$ | $N_2$ = 8,000 | 10,500 | 13,000 | 16,000 |
|---|---|---|---|---|
| $\phi$ = 0 | 23.2 | 27.5 | 62.5 | 117.0 |
| 0.10 | 22.4 | 26.4 | 60.8 | 114.7 |
| 0.20 | 20.7 | 24.1 | 57.3 | 110.0 |
| 0.40 | 16.8 | 18.8 | 48.9 | 98.7 |
| 0.60 | 15.3 | 16.7 | 45.7 | 94.4 |
| 1.00 | 15.0 | 16.3 | 45.0 | 93.5 |

TABLE 4

| $N_2$ | 8,000 | 10,500 | 13,000 | 16,000 |
|---|---|---|---|---|
| $G_{ROTOR}$ | 18.1 | 22.1 | 50.0 | 91.1 |

TABLE 4-continued

| $N_2$ | 8,000 | 10,500 | 13,000 | 16,000 |
|---|---|---|---|---|
| $G_W$ | 18.5 | 25.3 | 41.8 | 76.9 |

TABLE 5

| m | 4.36 | 14.81 | 52.26 | 104.52 |
|---|---|---|---|---|
| $g_{case}$ | 0.0022 | 0.0050 | 0.0118 | 0.0189 |
| $g_{rotor}$ | 0.0010 | 0.0030 | 0.0070 | 0.0108 |

TABLE 6

| $\phi$ | 0 | 0.14 | 0.55 | 1.00 |
|---|---|---|---|---|
| $h(\phi)$ | 1.0 | 1.0 | 1.65 | 1.65 |

In practice, a controller having the mathematical relationships and table values disclosed herein would be stored within the memory of a controller and referenced continuously by the controller to determine the current synthesized radial clearance. As noted hereinabove, the synthesized clearance is compared to the required steady state clearance at the current engine power level as determined from high rotor speed $N_2$ and, for those values wherein the synthesized clearance is less than the required steady state clearance, the controller acts to close the modulating valve 44 thereby restoring sufficient clearance until the transient effects of prior engine operation have passed.

We claim:

1. A method for modulating the flow of cooling air for reducing the radial clearance between a plurality of rotating blade tips and a surrounding shroud in a gas turbine engine, comprising the steps of:

measuring engine operating parameters, including high rotor speed, low rotor speed, low compressor inlet temperature, low compressor outlet temperature and low compressor inlet pressure, determining, responsive to the measured engine operating parameters, a flow parameter m such that $$m = \frac{W_{2.6}\sqrt{\theta_{2.6}}}{\delta_{2.6}} \frac{P_{2.6}}{P_2} P_2 (T_{2.6})^{-.5},$$

determining, responsive to the measured engine parameters, a current estimated clearance $\delta$ between the inner diameter of the shroud and the rotating blade tips, $\delta$ being determined by the equation $$\delta = G'_{case} - G'_{rotor} - G_w(N_2)$$

wherein the rate of change of $G'_{case}$ and $G'_{rotor}$ per unit time are determined by the equations:

$$\frac{dG'_{case}}{dt} = g_{case}(m)h(\phi)[G_{case}(N_2,\phi) - G'_{case}]$$

$$\frac{dG'_{rotor}}{dt} = g_{rotor}(m)[G_{rotor}(N_2) - G'_{rotor}].$$

wherein $h(\phi)$ is a heat transfer parameter based upon the position $\phi$ of a cooling air flow modulating valve, and modulating the flow of cooling air responsive to the current estimated clearance between the shroud and blade tips.

* * * * *